US008224201B2

(12) United States Patent
Komoto

(10) Patent No.: US 8,224,201 B2
(45) Date of Patent: Jul. 17, 2012

(54) IMAGE HEATING APPARATUS FOR CONTROLLING A VOLTAGE APPLIED TO A HEATER

(75) Inventor: Masahiro Komoto, Shida-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 12/707,526

(22) Filed: Feb. 17, 2010

(65) Prior Publication Data

US 2010/0209130 A1 Aug. 19, 2010

(30) Foreign Application Priority Data

Feb. 18, 2009 (JP) ..... 2009-035627

(51) Int. Cl.
*G03G 15/20* (2006.01)

(52) U.S. Cl. ..... 399/69; 399/329

(58) Field of Classification Search ..... 399/67, 399/69, 88, 329
See application file for complete search history.

(56) References Cited

U.S. PATENT DOCUMENTS 5,444,521 A * 8/1995 Tomoyuki et al. ..... 399/69
5,682,576 A * 10/1997 Sakai et al. ..... 399/69
5,682,577 A * 10/1997 Kiyoi ..... 399/69
5,994,671 A * 11/1999 Suzuki et al. ..... 399/329 X
7,003,239 B2 * 2/2006 Tanaka ..... 399/69
7,010,241 B2 * 3/2006 Nakayama ..... 399/69
7,321,738 B2 * 1/2008 Kaji et al. ..... 399/69
7,346,306 B2 * 3/2008 Cho ..... 399/329
7,634,209 B2 * 12/2009 Tanaka ..... 399/69

FOREIGN PATENT DOCUMENTS

JP 2006-113364 A 4/2006

* cited by examiner

*Primary Examiner* — Sandra Brase
(74) *Attorney, Agent, or Firm* — Canon USA, Inc., IP Division

(57) ABSTRACT

An image heating apparatus includes an endless belt configured to heat a toner image on a recording material, a heater configured to heat the endless belt, a voltage supplier configured to supply an alternating voltage to the heater, a temperature detector configured to detect a temperature of the heater, a controller configured to control a ratio of a time during which the voltage is supplied to the heater to a period at which the voltage is supplied to the heater according to the temperature detected by the temperature detector, and a regulator configured to regulate a maximum value of the ratio according to the temperature detected by the temperature detector by varying the voltage supplied to the heater at a predetermined period.

12 Claims, 10 Drawing Sheets

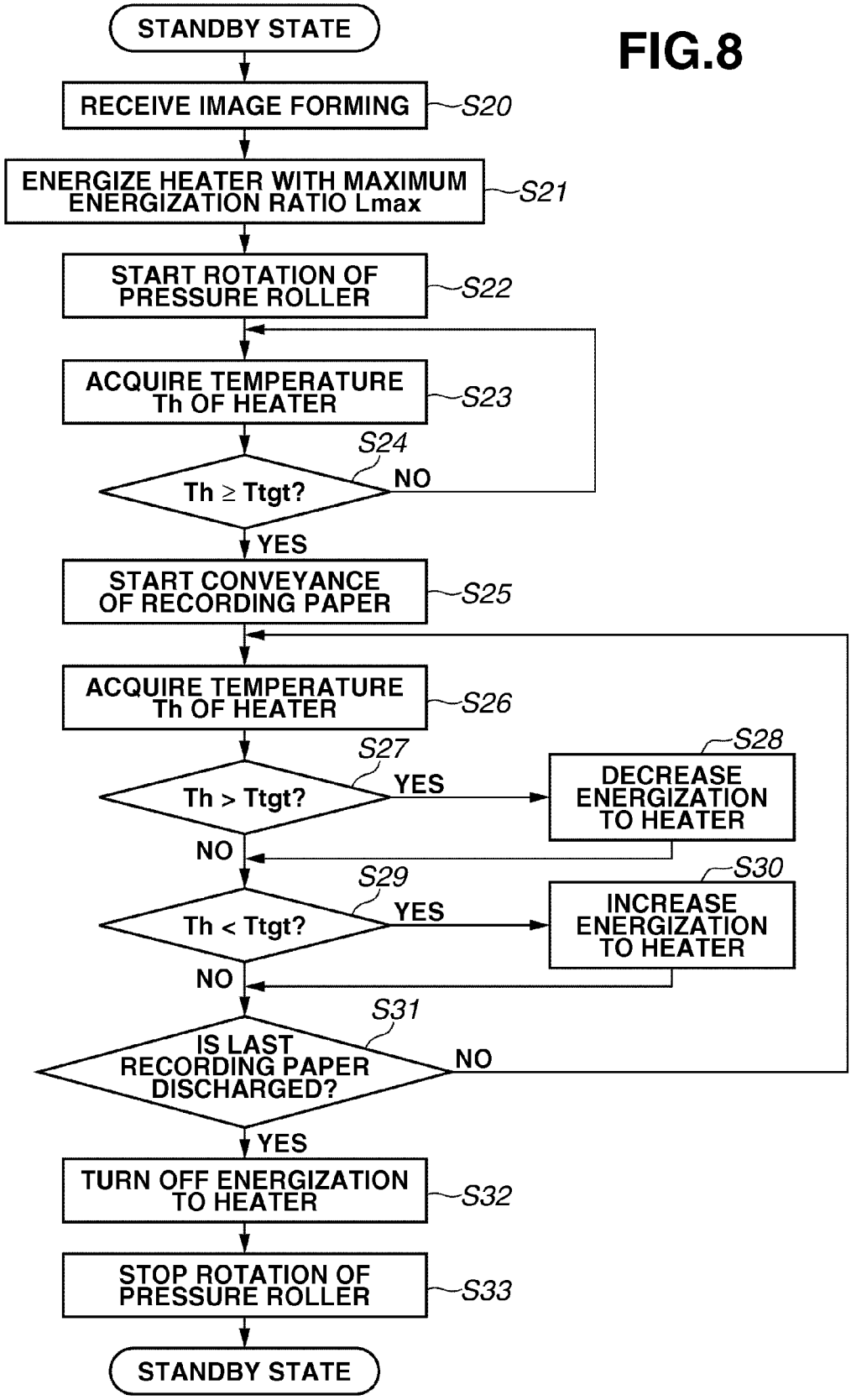
FIG.8
STANDBY STATE
RECEIVE IMAGE FORMING
S20
ENERGIZE HEATER WITH MAXIMUM ENERGIZATION RATIO Lmax
S21
START ROTATION OF PRESSURE ROLLER
S22
ACQUIRE TEMPERATURE Th OF HEATER
S23
S24
Th ≥ Ttgt?
NO
YES
START CONVEYANCE OF RECORDING PAPER
S25
ACQUIRE TEMPERATURE Th OF HEATER
S26
S27
Th > Ttgt?
YES
S28
DECREASE ENERGIZATION TO HEATER
NO
S29
Th < Ttgt?
YES
S30
INCREASE ENERGIZATION TO HEATER
NO
S31
IS LAST RECORDING PAPER DISCHARGED?
NO
YES
TURN OFF ENERGIZATION TO HEATER
S32
STOP ROTATION OF PRESSURE ROLLER
S33
STANDBY STATE

IMAGE HEATING APPARATUS FOR CONTROLLING A VOLTAGE APPLIED TO A HEATER

BACKGROUND OF THE INVENTION

1. Field of the Invention

The present invention relates to an image heating apparatus used in an image forming apparatus such as a copying machine, printer, facsimile apparatus, or multifunction peripheral having a variety of these functions.

2. Description of the Related Art

There is demand for a fixing apparatus capable of increasing temperature from a low temperature to a fixable temperature for shortening the time required to form an image after a power supply is turned on. One method of realizing the demand is supplying as much electric power as possible to the fixing apparatus in increasing temperature. However, the current flowing in the fixing apparatus is not allowed to exceed the rated current of a commercial power supply, so that the electric power to be supplied is inevitably limited.

The current flowing in increasing the temperature of the fixing apparatus depends on the resistance of a heater for heating a fixing member (heating member). As an example, if a ceramic heater is used, the resistance has a tolerance of approximately ±10%. At this point, the electric power supplied to the fixing apparatus including a resistance with a tolerance of +10% is reduced by approximately 20% of the electric power supplied to the fixing apparatus including a resistance with a tolerance of −10% if the applied voltage is the same, so that the fixing apparatus including a resistance with a tolerance of +10% consumes time for increasing temperature. On the other hand, increasing voltage applied to the heater so that the fixing apparatus including a resistance with a tolerance of +10% can increase temperature in a short time causes current flowing in the fixing apparatus including a resistance with a tolerance of −10% to exceed the rated current.

In situations where the voltage of a commercial power supply is unstable, variations in voltage affect current flowing in the fixing apparatus. If the voltage of a commercial power supply varies by ±10%, the electric power supplied to the fixing apparatus is reduced by approximately 40% at a maximum, in combination with a tolerance of ±10% of the resistance in the heater.

In an apparatus discussed in Japanese Patent Application Laid-Open No. 2006-113364, a heater is energized and the supplied electric power is estimated based on variations in the temperature of the heater to be energized to adjust the voltage applied to the heater.

In the apparatus discussed in Japanese Patent Application Laid-Open No. 2006-113364, however, a part of the electric power supplied, to the heater is used for increasing the temperature of the heater and the other parts thereof turn into heat transmitted to a pressure roller in contact with the fixing member. The quantity of heat transmitted to the pressure roller is varied with the influence of temperature and hardness of the pressure roller. Therefore, it is difficult to accurately measure the supplied electric power by the method discussed in Japanese Patent Application Laid-Open No. 2006-113364.

Low accuracy of detecting electric power is attributed to that the electric power supplied in heating is obliged to be reduced. Suppose that the electric power used in the fixing apparatus is 1000 W, for example. If a detection error of electric power is ±5%, the electric power is controlled to 952 W or less in design to guarantee that the electric power does not exceed 1000 W even if the electric power is shifted by +48 W due to a detection error of +5%. However, a detection error of electric power is as high as ±20%, the electric power needs to be controlled to 833 W or less to fall within 1000 W, or less if the electric power is shifted by +167 W due to a detection error of +20%.

A method for directly measuring the electric power supplied to the fixing apparatus and a method for measuring the temperature of the pressure roller need to specially provide a measuring instrument.

SUMMARY OF THE INVENTION

The present invention is directed to an image heating apparatus capable of adequately controlling a voltage applied to a heater by accurately obtaining an electric power supplied to the heater.

According to an aspect of the present invention, an image heating apparatus includes an endless belt configured to heat a toner image on a recording material, a heater configured to heat the belt, a voltage supplier configured to supply an alternating voltage to the heater, a temperature detector configured to detect a temperature of the heater, a controller configured to control a ratio of a time during which the voltage is supplied to the heater to a period at which the voltage is supplied to the heater according to the temperature detected by the temperature detector, and a regulator configured to regulate a maximum value of the ratio according to the temperature detected by the temperature detector by varying the alternating voltage supplied to the heater at a predetermined period.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 8 is a flow chart illustrating the outline of a fixing operation.

DESCRIPTION OF THE EMBODIMENTS

Various exemplary embodiments, features, and aspects of the invention will be described in detail below with reference to the drawings.

Figure 3:
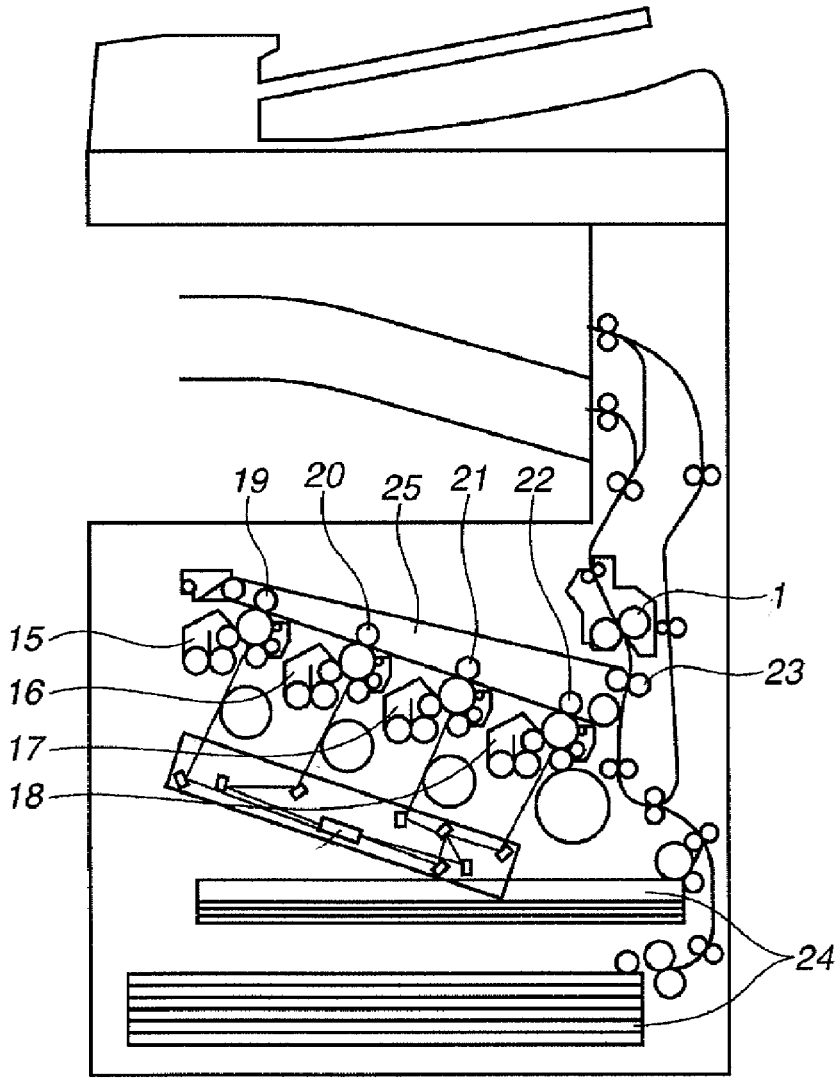
FIG. 3 is a cross section of an image forming apparatus provided with the fixing apparatus according to an exemplary embodiment of the present invention.

A copying machine according to an exemplary embodiment of the present invention is cited as an example and the configuration thereof is briefly described below. FIG. 3 is a cross section of the copying machine, to which a dry electrophotographic method is applied. Image forming cartridges 15 to 18 form toner images corresponding to yellow, magenta, cyan, and black, respectively. The toner images formed by the image forming cartridges are sequentially transferred to an intermediate transfer member 25 at primary transfer units 19 to 22 to form a full-color toner image. The toner image formed on an intermediate transfer belt 25 as the intermediate transfer member is conveyed to a secondary transfer unit 23 by the rotation of the intermediate transfer belt 25. In the secondary transfer unit 23, the toner image is transferred to a recording paper as a recording material conveyed from a paper feeding unit 24. The recording paper to which the toner is transferred is conveyed to a fixing apparatus 1 as an image heating apparatus and the toner is heated and fixed to the recording paper. A visible image is thus formed on the recording paper through the above processes.

Figure 1:
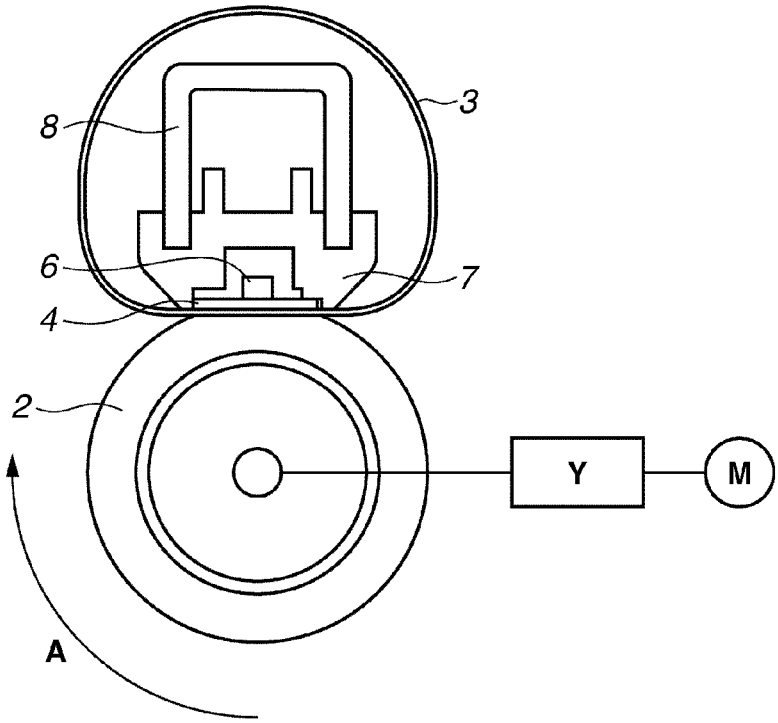
FIG. 1 is a cross section of a fixing apparatus according town exemplary embodiment of the present invention.

A fixing apparatus 1 according to the exemplary embodiment of the present invention is described more in detail. FIG. 1 is a cross section of the fixing apparatus 1. The fixing apparatus 1 includes a heater pressure member 8, a heater supporting member 7, a heater 4, a heater temperature sensor 6 as a temperature detector, a fixing film 3 as a heating belt, and a pressure roller 2 as a pressure member (nip forming member).

Figure 4:
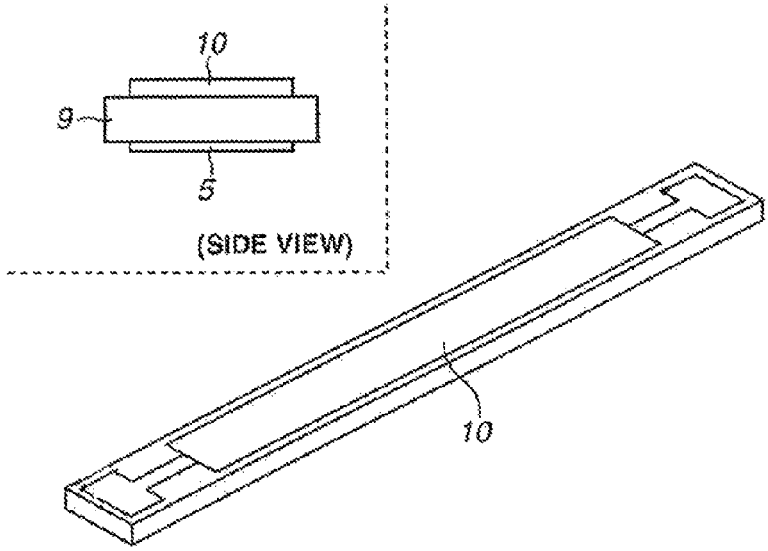
FIG. 4 is a schematic diagram illustrating a detailed configuration of a heater.

The heater 4 is formed such that a resistor 10 is printed on a ceramic substrate 9 as illustrated in FIG. 4. A polyimide 5 is formed on the other side of the surface where the resistor 10 is formed to reduce friction between the heater 4 and the fixing film 3. The heater 4 is attached in the direction in which the resistor 1 faces the heater supporting member 7.

The heater supporting member 7 and the heater pressure member 8 are those for pressing the heater 4 against the pressure roller 2. Both ends of the heater pressure member 8 are supported by a spring (not shown) and the heater 4 is pressed against the pressure roller 2 by a force of approximately 300 N.

The fixing film 3 is produced such that an approximately 300 μm thick silicone rubber is coated on a thin-walled metallic cylinder with a diameter of 25 mm and a thickness of approximately 35 μm and rotates together with the pressure roller 2.

The pressure roller 2 is configured such that an approximately 3 mm thick silicone rubber is coated around a 20 mm diameter aluminum hollow cylinder. The pressure roller 2 is not provided with a heater and a temperature sensor and heated only by heat conduction from the heater 4 through the fixing film 3. The pressure roller 2 is driven by a motor M through a gear train Y.

The fixing apparatus 1 according to the present exemplary embodiment is provided only with the temperature sensor 6 for measuring the temperature of the heater 4 as a temperature detector. In the present exemplary embodiment, the temperature sensor 6 is a negative temperature coefficient (NTC) thermister and provided in the longitudinal center of the resistor 10.

While the fixing apparatus 1 is in operation, the pressure roller 2 rotates in the direction of an arrow A indicated in FIG. 1 and the recording paper (recording material) on which the toner image is transferred by the secondary transfer unit 23 is conveyed from left to right in FIG. 1. The recording paper is heated and pressed by the fixing nip portion N as a nip portion sandwiched between the fixing film 3 and the pressure roller 2 to fix the toner image on the recording paper. The fixing apparatus 1 is attached to a copying machine with the fixing apparatus 1 rotated counterclockwise by approximately 90 degrees from the state indicated in FIG. 1.

The electrical specifications of the heater 4 are described below. The image forming apparatus according to the present exemplary embodiment is designed for a rated voltage and current of 100 V and 15 A. Motors and electric equipment in the image forming apparatus consume a current of 4 A, so that the current allowed to flow from a voltage supplier to the heater 4 is up to 11 A.

The heater 4 is formed such that the resistor 10 is printed on the surface of the ceramic substrate 9 as described above. The dispersion of thickness of the resistor 10 in the formation thereof varies the resistance of the heater 4 with a range of ±10%.

In the present exemplary embodiment, the resistance of the heater 4 is set at 9.14Ω±10%. The set resistance ensures a heat generation of 952 W by combining the upper limit of resistance of 10.05Ω with a rating voltage of 100 V (root mean square value). The set resistance also ensures a heat generation of 995 W close to 952 W by combining the lower limit of resistance of 8.23Ω with the upper limit of current of 11 A.

The heater 4 having the resistance set as above is 100% energized (a voltage of 100 V, root mean square value, is applied) without control to cause a current of 12.2 A to flow by a combination of a rated voltage of 100 V (root mean square value) and the lower limit of resistance of 8.23Ω, for example, exceeding the rated current. A control needs to be performed so that current flowing into the heater 4 does not to exceed the rated current by detecting the current or electric power flowing therein.

A control circuit 12 functioning as a controller or a regulator (setting unit) for controlling the fixing apparatus 1 is described below.

Figure 5:
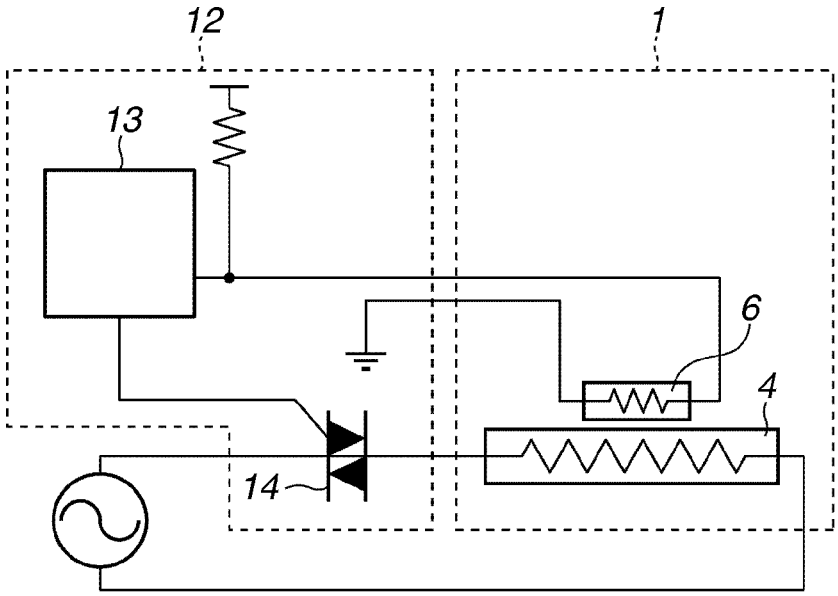
FIG. 5 is a schematic diagram of a control circuit.

The control circuit 12 (not shown in FIG. 3) is disposed on the back face of the copying machine in FIG. 3. FIG. 5 is a schematic diagram of a portion related to the fixing apparatus in the control circuit 12. The control circuit 12 includes an MPU 13 storing a control program and a TRIAC 14 for turning on and off an electric power. The heater temperature sensor 6 is connected to an AD converter incorporated in the MPU 13 and reads a change in the temperature of the heater 4 as a change in resistance. Although described in detail in the following paragraphs, the MPU 13 adjusts a ratio of the electric power supplied to the heater 4 (energization time to an energization period) according to the read temperature to control the temperature of the heater 4.

The control circuit 12 controls the electric power supplied to the heater 4 by turning on and off the TRIAC 14 in synchronization with the alternating current waveform (alternating voltage) of a commercial power supply.

Figure 6:
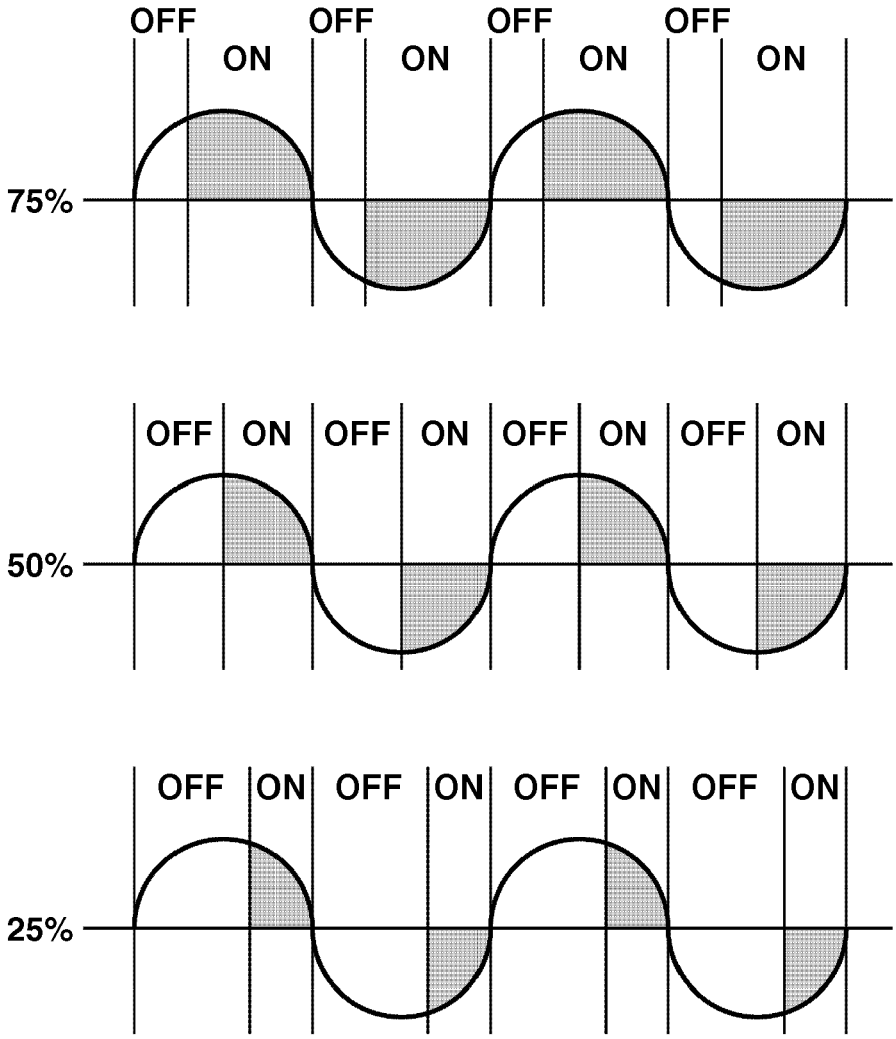
FIG. 6 is a diagram illustrating an energization ratio.

As illustrated in FIG. 6, the timing at which the TRIAC 14 is turned on is changed according to a ratio of the electric power supplied to the heater 4. When a large amount of electric power is supplied to the heater 4, the timing at which the TRIAC 14 is turned on is advanced. When a small amount of electric power is supplied to the heater 4, the timing at which the TRIAC 14 is turned on is delayed.

Although FIG. 6 illustrates three typical energization ratios of 25%, 50%, and 75%, the present exemplary embodiment can control an electric power supplied to the heater 4 at 21-step energization ratios from 0% to 100% in increments of 5%. In the present exemplary embodiment, the term "energization ratio" refers to the ratio of a time during which an electric power is supplied to the heater 4 to a period at which the voltage of alternating current waveform of a commercial power supply changes.

Figure 7:
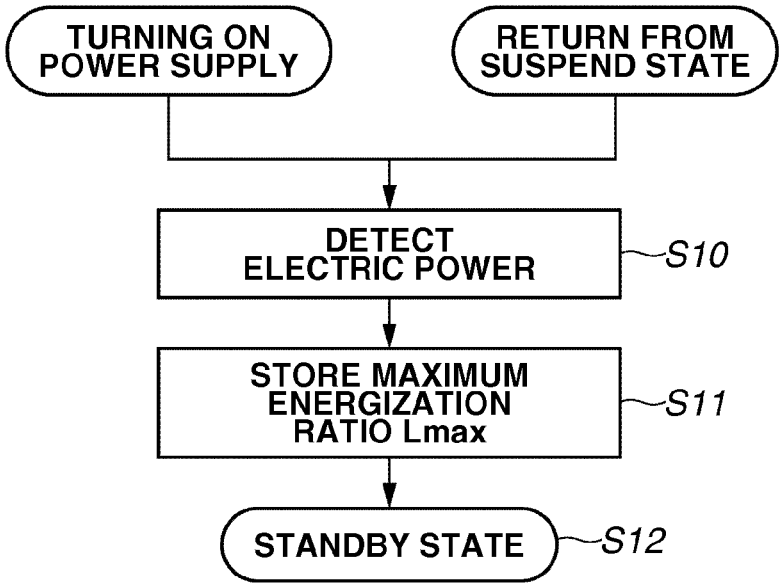
FIG. 7 is a flow chart illustrating the outline of operation at the time of turning on a power supply and returning from a suspend state.

The following describes control incorporated in the MPU 13. FIG. 7 illustrates how the image forming apparatus operates immediately after the power supply is turned on. FIG. 8 illustrates the process related to the fixing operation.

In the image forming apparatus according to the present exemplary embodiment, every time the power supply of the image forming apparatus is turned on or the image forming apparatus returns from a suspend state, electric power detection control is performed in step S10. An electric power detection operation is described in detail in the following paragraphs. After the electric power detection control is finished, in step S11, the maximum energization ratio $L_{max}$ being the result of the electric power detection control is stored in a main storage unit incorporated in the MPU 13. Thereafter, in step S12, the image forming apparatus is in a standby state in which the image forming apparatus can start a printing operation.

Figure 9:
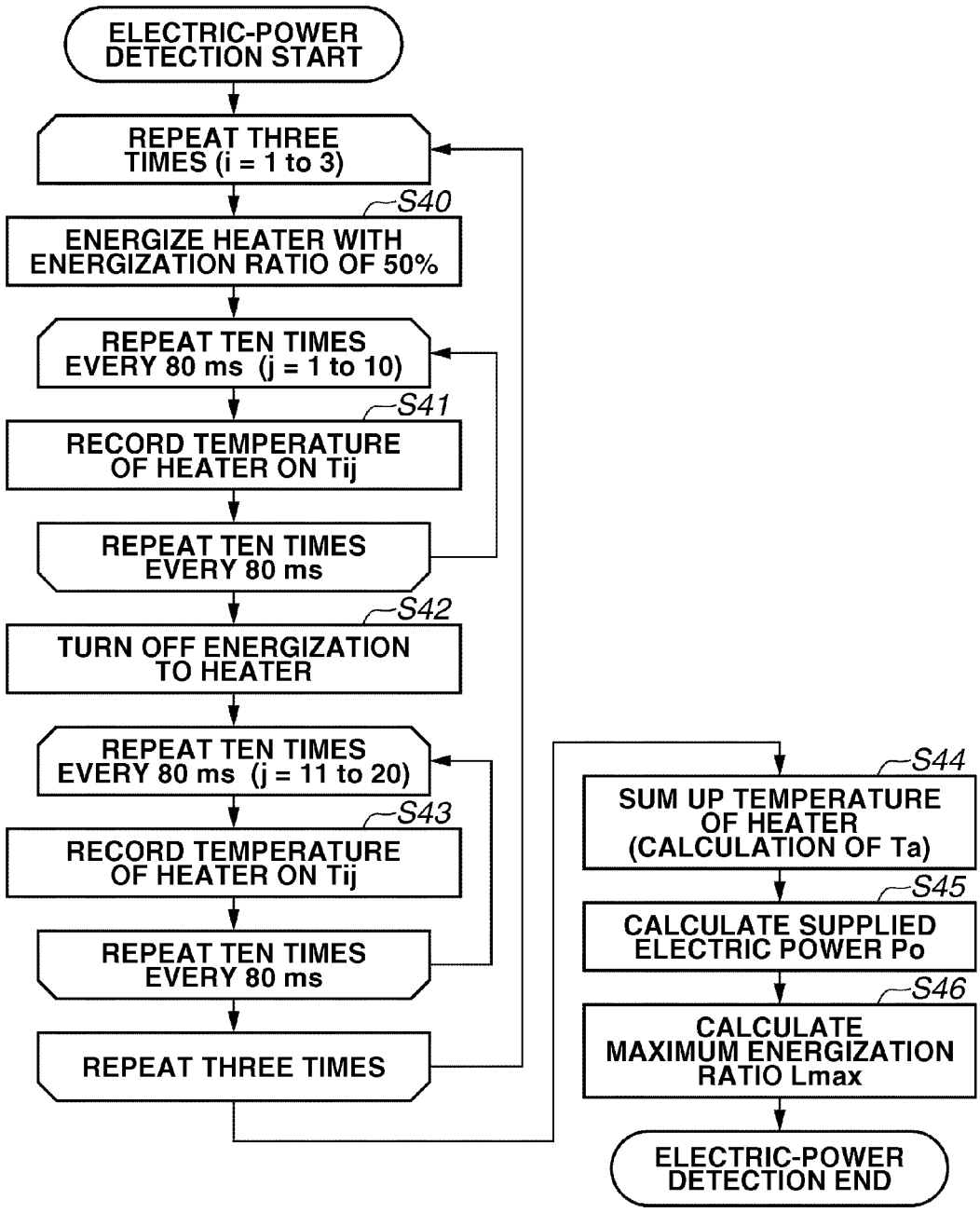
FIG. 9 is a flow chart illustrating the outline of an electric power detection operation.
Figure 10:
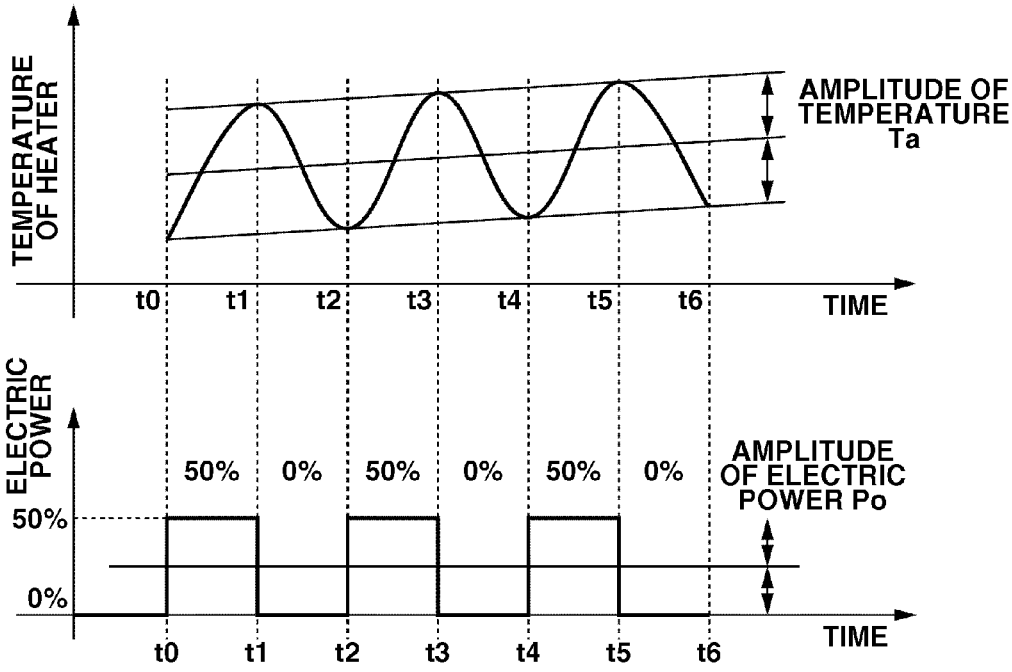
FIG. 10 illustrates a change in temperature of a heater in periodically varying electric power to be supplied.

The electric power detection operation is described below. FIG. 9 illustrates the flow of control of the electric power detection operation. FIG. 10 illustrates a change in temperature and the energization control of the heater 4 during the electric power detection operation.

In step S40, an electric power is supplied to the heater 4 for 0.8 seconds (t0 to t1) at an energization ratio of 50% and then, in step S42, the electric power supplied to the heater 4 is turned off for 0.8 seconds (t1 to t2). This operation is repeated by three cycles (t0 to t6), during which the temperature of the heater 4 is measured using the heater temperature sensor 6 and recorded in steps S41 and S43.

Turning on and off the electric power varies the temperature of the heater 4 up and down as illustrated in FIG. 10. In step S44, the amount corresponding to an amplitude $T_a$ of change in the temperature at this point is acquired from the temperature recorded in steps S41 and S43. Since the amplitude Ta of change in the temperature is proportional to a supplied electric power Po, in step S45, the electric power Po can be acquired from the amplitude $T_a$ acquired in step S44, from which the maximum energization ratio $L_{max}$ (%) at which the electric power Po does not exceed the rating can be acquired in step S46.

In the present exemplary embodiment, the maximum energization ratio $L_{max}$ (%) is acquired from the amount of change in electric power supplied for 4.8 seconds (a predetermined period is 0.8 seconds) between t0 to t6 and the amount of change in the temperature of the heater 4 at that point.

The process in step S44 in FIG. 9 is described in detail below. If the amplitude of temperature at a first period during which the electric power supplied to the heater 4 is turned on and off is taken as $T_a$ (1), that at a second period is taken as $T_a$ (2), and that at a third period is taken as $T_a$ (3), the amplitude of temperature $T_a$ can be acquired by equations (1) and (2) as an average of three periods. N is a frequency in which temperature is recorded for a period. In the present exemplary embodiment, the frequency is 20, but even if temperature is recorded at a higher frequency, the amplitude of temperature $T_a$ can be similarly acquired.

$$T_a(i) = -\frac{2}{N}\sum_{j=1}^{N} T_{i,j}\cos\left(\frac{2\pi j}{N}\right),\ N \equiv 20 \tag{1}$$

$$T_a = \frac{T_a(1) + T_a(2) + T_a(3)}{3} \tag{2}$$

The process in step S45 is described below. In steps 40 and 42, the electric power is supplied to the heater 4 while energization ratios of 50% and 0% are alternately repeated. The amplitude of temperature $T_a$ as the amount of change in the temperature of the heater 4 is proportional to the supplied electric power Po, which is represented by equation (3):

$$Po = \xi T_a \tag{3}$$

where, ξ is a constant depending on the heat capacity of the heater 4 and a period at which the electric power is turned on and off and ξ of a fixing apparatus by which the inventor performed an experiment was ξ≈26.7 (W/° C.). Po is the amplitude of an electric power. The Po acquired here is an electric power corresponding to an energization ratio of 25%. The energization ratio of 25% means ½ of a difference between the maximum and the minimum value of the supplied electric power periodically varied in the electric power detection operation. In other words, the energization ratio of 25% means ½ of a difference (50%-0%) between an energization ratio of 50% of the electric power supplied in step S40 in FIG. 9 and an energization ratio of 0% at the time of turning off the electric power in step S42. In steps S40 and S42, the electric power may be supplied at energization ratios of 60% and 10%, respectively.

As described above, in the present exemplary embodiment, the minimum value at the time of periodically changing the supplied electric power in a predetermined period is taken as zero (W). For this reason, a consumption power at the electric detection process can be reduced as much as possible.

In the experiment of acquiring the aforementioned ξ, the inventor measured the temperature of the heater 4 by the method illustrated in FIG. 9 while measuring the electric power supplied to the heater 4 by a wattmeter. The temperature of the heater 4 was measured by the heater temperature sensor 6.

The calculation of the maximum energization ratio $L_{max}$ in step S46 is described below. As described in the configuration of the fixing apparatus, even if the resistance of the heater 4 is 8.23Ω being the lower limit thereof, the current flowing in the heater 4 can be lowered to the rated current of 11 A or less by reducing the electric power to 995 W or less. Since the electric power corresponding to an energization ratio of 25% is Po based on the calculation in step S45, the maximum energization ratio $L_{max}$ is determined by the following equation (4) to use an energization ratio equal to or less than the maximum energization ratio $L_{max}$, thereby ensuring that the current flowing into the heater 4 is 11 A or less. It is estimated that the detection error of Po is on the order of 5%. Up to 95% of the detection result is used.

$$L_{max} = 95(\%) \times \frac{995(\mathrm{W})}{4P_0} \tag{4}$$

The detection operation and result in the case where the resistance of the heater 4 is 8.23Ω being the lower limit thereof and a commercial power supply voltage is 100 V are exemplified as an example of an actual detection. Supplying an electric power to the heater 4 with the above combination at an energization ratio of 100% generates heat of 1215 W. The repetition of energization ratios of 50% and 0% in steps S40 and S42 repeats between heats of 608 W and 0 W. At this point, in the fixing apparatus 1 according to the present exemplary embodiment, the amplitude of temperature in the heater 4 is on the order of 11.4° C. Since a measurement error existing in the amplitude of temperature is approximately ±5%, in step S44, the amplitude of temperature actually detected disperses within a range of 10.8° C.<$T_a$<12.0° C. If $T_a$ of 10.8° C. on the side of the minimum error is detected, Po acquired by equation (3) in step S45 is 288 W. The maximum energization ratio $L_{max}$ can be determined from the result of Po using equation (4) in step S46:

$$L_{max}=95\%\times995\text{ W}/4\times288\text{ W}=82\%.$$

The determined $L_{max}$ is confirmed. $L_{max}$ is an energization ratio at which the current does not exceed the rated current if it is the maximum energization ratio $L_{max}$ or less. An electric power will be obtained in the case where an electric power is supplied to the heater 4 at an energization ratio of 82% under the condition that the above resistance is 8.23Ω and a power supply voltage is 100 V. Supplying an electric power at an energization ratio of 100% generates an electric power of 1215 W, which generates an electric power of 1215 W×82%=996 W. The current obtained at this point is 11.0 A, which is the rated current. The maximum energization ratio $L_{max}$ is determined by the above method to allow the control of the fixing apparatus 1 so that current does not exceed the rated current.

The standby state in step S12 is briefly described below. The standby state refers to a state in which the image forming apparatus can immediately transfer to the fixing operation when a user performs a copying operation.

In the fixing apparatus 1 according to the present exemplary embodiment, for the sake of prioritizing energy saving, an electric power is not supplied to the heater 4 and the rotation of the pressure roller 2 (also the rotation of the film) is stopped in the standby state.

The user may change the setting to a setting in which user friendliness is prioritized in operation. In this case, the heater 4 is kept warm at a temperature of 90° C. lower than a temperature in fixing toner on the recording paper in the standby state and the rotation of the pressure roller 2 is stopped. Thus, it is possible to more quickly start forming an image, allowing improvement in user friendliness.

The fixing operation is described below. FIG. 8 outlines the process of the fixing operation.

In step S20, the user's receiving an image forming signal by pressing a copy button transfers the standby state to the fixing operation of the fixing apparatus 1. In the fixing apparatus 1 being in the standby state, energization is generally stopped, so that temperature of the heater 4 and the fixing belt 3 is maintained at a normal temperature. The fixing apparatus 1 needs to be heated to melt toner on the recording paper, fixing it thereon. In the fixing apparatus 1 according to the present exemplary embodiment, the heater 4 is heated (temperature is increased) to a heater target temperature $T_{tgt}$ of 220° C. (a predetermined temperature) to allow toner to be fixed on the recording paper.

For that reason, before starting the fixing operation, the heater 4 is heated to the heater target temperature $T_{tgt}$. In step S21, the heater 4 is energized at the maximum energization ratio $L_{max}$ determined using equation (4) to finish heating as quickly as possible. In step S22, the rotation of the pressure roller 2 is started simultaneously with the energization.

As described previously, the maximum energization ratio $L_{max}$ ensures that the current does not exceed the rated current to allow achieving a conflicting object in which the heater is heated as quickly as possible and the current does not exceed the rated current.

In step S23, the temperature of the heater 4 is monitored in heating. In step S24, if the temperature $T_h$ of the heater 4 reaches the heater target temperature $T_{tgt}$, the process proceeds to an operation for actually fixing toner on the recording paper.

In step S25, when the temperature $T_h$ of the heater 4 reaches the heater target temperature $T_{tgt}$, the image forming apparatus starts an operation for conveying the recording paper to the fixing apparatus 1 by driving the paper feeding unit 24.

In steps S26 to S30, the fixing apparatus 1 performs an operation for keeping the heater 4 at the heater target temperature $T_{tgt}$ to fix toner on the recording paper.

A process is periodically performed in which: in step S26, the temperature of the heater 4 is measured; in step S27, if the temperature of the heater 4 is higher than the heater target temperature $T_{tgt}$, in step S28, the energization ratio is lowered by 5%; and in step S29, if the temperature of the heater 4 is lower than the heater target temperature $T_{tgt}$, in step S30, the energization ratio is increased by 5%.

The process is repeated until all recording papers on which toner is fixed are discharged (step S31). When the last recording paper is discharged, in step S32, the energization to the heater 4 is turned off and, in step S33, the rotation of the pressure roller 2 is stopped. Then, the process is in standby state.

The following describes the reason why the technique of the present exemplary embodiment can more accurately detect an electric power than a conventional technique.

Figure 2:
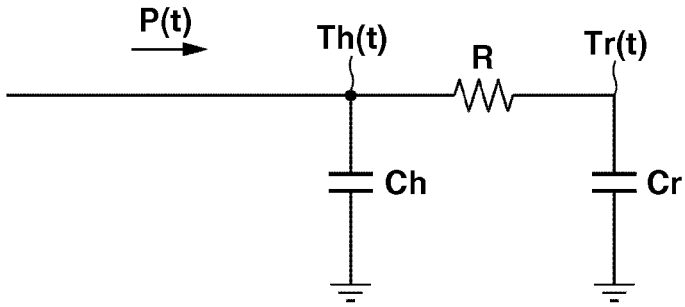
FIG. 2 schematically illustrates thermal conduction.

The thermal state of the fixing apparatus can be typified by the temperature of the heater 4 and the pressure roller 2 large in heat capacity, so that the thermal conduction of the system is schematically illustrated by FIG. 2. P(t) is an electric power supplied to the heater 4. Ch and Cr are heat capacity of the heater 4 and the pressure roller 2, respectively. $T_h(t)$ and $T_r(t)$ are temperatures of the heater 4 and the pressure roller 2, respectively. R is a thermal resistance between the heater 4 and the pressure roller 2.

In the method discussed in Japanese Patent Application Laid-Open No. 2006-113364, electric power is detected by measuring increase in the temperature of the heater 4 when a constant electric power P is supplied to the heater 4. If a thermal circuit is assumed as illustrated in FIG. 2, the electric power P can be represented by equation (5). The first term of equation (5) represents the quantity of heat used for increasing the temperature of the heater 4 and the second term thereof represents the quantity of heat flowing from the heater 4 to the pressure roller 2.

$$P = C_h\frac{dT_h(t)}{dt} + \frac{T_h(t) - T_r(t)}{R} \tag{5}$$

The method discussed in Japanese Patent Application Laid-Open No. 2006-113364 corresponds to the obtainment of the electric power P using equation (5). The first term represents the differentiation of temperature of the heater 4 with reference to time and the temperature is measured by the heater temperature sensor 6. The coefficient Ch is the heat capacity of the heater 4 and depends on specific heat and mass of the heater 4. The ceramic heater used as the heater 4 in the present exemplary embodiment is very small in dispersion of the heat capacity. For this reason, the first term of equation (5) can be accurately obtained.

On the other hand, the second term can not be accurately obtained by the method discussed in Japanese Patent Application Laid-Open No. 2006-113364. The second term includes the temperature $T_r$ of the pressure roller 2, but the pressure roller 2 is not provided with a temperature detection mechanism. The method obtains the temperature $T_r$ by estimating it based on an initial temperature $T_h(0)$ of the heater 4 using a table instead of measuring the temperature $T_r$.

R in the second term is a quantity large in dispersion. R is a thermal resistance between the heater 4 and the pressure roller 2. A contacting area is dispersed by the rubber hardness and the pressure force of the pressure roller 2, so that the thermal resistance R itself is large in dispersion. Thus, in the method discussed in Japanese Patent Application Laid-Open No. 2006-113364, the thermal resistance R and the temperature $T_r$ are large error factors. Therefore, the method can detect the electric power P with an error of approximately ±20%.

The method of detecting electric power according to the present exemplary embodiment is described below. The present exemplary embodiment is characterized by periodically varying the energization to the heater 4 in detecting electric power instead of keeping the energization constant. Alternating current high enough in frequency is applied to P(t) with FIG. 2 compared to an electric circuit. If FIG. 2 is considered as an electric circuit, the thermal resistance R and the heat capacity Cr form a low pass filter (LPF), so that an alternating current component does not flow into the pressure roller 2. In other words, measurement can be performed without being affected by the thermal resistance R and the temperature $T_r$ large in error.

A change in temperature $T_h$ of the heater 4 in inputting a periodical electric power to P(t) is actually obtained. As an example, if the electric power P is taken as a sinusoidal wave, i.e., P(t)=Po (1+sin(ωt), the equations to be solved are represented by equations (6) and (7).

$$\frac{d}{dt}(T_h(t) - T_r(t)) = -\frac{C_h + C_r}{RC_hC_r}(T_h(t) - T_r(t)) + \frac{P_0}{C_h}(\sin(\omega t) + 1) \tag{6}$$

$$\frac{d}{dt}(C_hT_h(t) + C_rT_r(t)) = P_0(\sin(\omega t) + 1) \tag{7}$$

A change in the temperature of the heater 4 can be represented by equation (8) by solving the above equations.

$$T_h(t) = -T_a\cos(\omega t - \delta) + C_he^{-t/\tau} + \frac{P_0}{C_h + C_r}t + const. \tag{8}$$

$$T_a \equiv \frac{P_0}{\omega}\sqrt{\frac{\omega^2R^2C_r^2 + 1}{\omega^2R^2C_h^2C_r^2 + (C_h + C_r)^2}} \tag{9}$$

$$\tau \equiv \frac{RC_hC_r}{C_h + C_r} \simeq RC_h \tag{10}$$

Gh is a constant determined by $T_h(0)$ and $T_r(0)$, but not important in the present invention. "const" in equation (8) is a constant term independent of time t and is not important in the present invention, so that a detailed description thereof is omitted. Equation (9) can be approximated to equation (11) by setting ω to sufficiently high frequencies in equation (8).

$$T_a \simeq \frac{P_0}{\omega C_h},\ \delta \simeq 0\left(\omega \gg \frac{1}{\tau}\right) \tag{11}$$

The present exemplary embodiment is characterized by measuring the amplitude $T_a$ of a change in temperature (amount of change) at the time of periodically changing electric power to be supplied. Equation (11) indicates that the electric power P is proportional to the amplitude $T_a$ of a change in temperature and a proportionality coefficient is ωCh. Ch is the heat capacity of the heater 4 and a quantity small in dispersion as described earlier.

Since ω is a period of electric power to be inputted, it has few errors. Accordingly, the accurate measurement of the amplitude $T_a$ allows obtaining the electric power Po with a small error.

The following describes a method of accurately measuring the amplitude $T_a$ of a change in temperature of the heater 4. The present exemplary embodiment uses Fourier transform as a method of measuring the amplitude $T_a$. A change in temperature of the heater 4 can be obtained by the equation (8) as described in the previous paragraph. For the sake of simplicity, a first-order approximation is applied to $e^{-t/\tau}$ to rewrite equation (8) into equation (12), performing the Fourier transform for one period.

$$T_h(t) \simeq -T_a\cos(\omega t) + kt + const. \tag{12}$$

$$\tilde{T}_h(\omega) = \int_0^{2\pi/\omega} T_h(t)\cos(\omega t)\,dt \tag{13}$$

$$= -\frac{\pi}{\omega}T_a \tag{14}$$

As represented by equation (13), the amplitude $T_a$ can be obtained from the result of the Fourier transform. The Fourier transform of equation (13) is discretized to allow mounting on the control circuit 12.

$$T_a = -\frac{\omega}{\pi}\int_0^{2\pi/\omega} T_h(t)\cos(\omega t)\,dt \tag{15}$$

$$\simeq -\frac{2}{N}\sum_{n=1}^{N} T_h(n)\cos(2\pi n/N) \tag{16}$$

The above result is quite similar to equation (1) that previously describes control. Equation (11) gives $T_a$=PoωCh, from which the electric power Po supplied to the heater 4 is instantly obtained and can be represented by the following equation:

$$P_0 = \xi T_a, \xi \equiv \omega C_h \tag{17}$$

Equation (17) is the same as equation (3) used in the description of the control. The amplitude $T_a$ of a change in the temperature of the heater 4 and the electric power Po can be obtained by the periodical measurement of temperature of the heater 4 and the discrete Fourier transform thereof.

The following describes the advantage of obtaining amplitude $T_a$ of a change in temperature using Fourier transform. The greatest advantage of this method lies in integration operation. The temperature $T_h$ of the heater 4 is measured by the heater temperature sensor 6. However, measurements contain an accidental error. Since the accidental error can be generally reduced by increasing the number of measurements, the integration operation which sums up a plurality of measurements is essentially immune from the influence of the accidental error.

In equation (6) and the subsequent equations, a sinusoidal wave is assumed as the electric power P(t). The exemplary embodiment described in the paragraph of the electric power detection operation uses not a sinusoidal wave, but an easy to control rectangular-wave electric power which is generated by turning on and off electric power. Both cases are similar in that the amplitude of temperature is measured with respect to a periodic input electric power, however, only different in that the constant is changed from $\xi=\omega Ch$ for the sinusoidal wave to $\xi=\pi\omega Ch/4$ for the rectangular wave.

Guidelines for determining a frequency $f=\omega/2\pi$ turning on and off electric power as an important designed value are described below in applying the configuration of the present exemplary embodiment. Since $\omega>>1/\tau$ in equation (11), a frequency f may be selected by equation (18).

$$f \gg \frac{1}{2\pi\tau} \tag{18}$$

For the fixing apparatus 1 according to the present exemplary embodiment, $\tau$=approximately 10 (sec) was obtained from the experiment. Consequently, setting f>0.2 Hz allows electric power to be detected without being affected by the pressure roller 2.

As another approach, $\delta=0$ in the case of $\omega>>1/\tau$ of equation (11) may be used. In other words, if a sufficiently high frequency is selected, $\delta=0$. However, if the frequency is increased, a phase $\delta$ is shifted to 90 degrees. Therefore, a phase difference $\delta$ is measured while the frequency f is being changed to determine the frequency f so that phase difference $\delta=0$ can be obtained.

The lower limit of the frequency f can be determined by the above approach. On the other hand, the upper limit of the frequency f is determined by the responsiveness of the heater temperature sensor 6. The heater temperature sensor 6 used in the present exemplary embodiment is lower in sensitivity with respect to a change in the temperature with a high frequency. It is hard for the heater temperature sensor 6 to accurately measure temperature if the frequency exceeds 4 Hz. Therefore, the heater temperature sensor 6 can accurately detect electric power within 0.2 Hz<f<4 Hz. In terms of a period, 0.2 Hz<f<4 Hz corresponds to 0.25 (sec)<f<5.00 (sec).

In the present exemplary embodiment, f=1/1.6=0.625 Hz is selected within 0.2 Hz<f<4 Hz. As illustrated in FIG. 9, this means that energization is repeated at an energization ratio of 50% for 0.8 seconds and at an energization ratio of 0% (a supplied electric power of 0 W) for 0.8 seconds. The reason why this frequency is selected is that, if an energization time is 0.8 seconds, the frequency of a commercial power supply of 50 Hz corresponds to 40 periods and that of a commercial power supply of 60 Hz corresponds to 48 periods, which are easy to control, whichever frequency of the commercial power supply is used.

As described above, in the present exemplary embodiment, the electric power supplied to the heater 4 is periodically varied and the amplitude of temperature of the heater 4 detected at that point is used to obtain the supplied electric power. The use of such a method allows electric power to be detected without being affected by the temperature of pressure roller 2 and dispersion in the thermal resistance between the heater 4 and the pressure roller 2.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-035627 filed Feb. 18, 2009, which is hereby incorporated by reference herein in its entirety.

What is claimed is:

1. An image heating apparatus comprising:

an endless belt configured to heat a toner image on a recording material;

a heater configured to heat the endless belt;

a voltage supplier configured to supply an alternating voltage to the heater;

a temperature detector configured to detect a temperature of the heater;

a controller configured to control a ratio of a time during which the voltage is supplied to the heater to a period at which the voltage is supplied to the heater in accordance with the temperature detected by the temperature detector; and a regulator configured to regulate a maximum value of the ratio in accordance with the temperature detected by the temperature detector by varying the alternating voltage supplied to the heater at a predetermined period.

2. The image heating apparatus according to claim 1, wherein the regulator regulates the maximum value of the ratio according to an amount of change in the temperature detected by the temperature detector.

3. The image heating apparatus according to claim 2, wherein the regulator decreases the maximum value of the ratio if the amount of change in the detected temperature is greater than a predetermined value.

4. The image heating apparatus according to claim 1, wherein the alternating voltage supplied to the heater is turned on and off at the predetermined period to regulate the maximum value of the ratio by the regulator.

5. The image heating apparatus according to claim 4, wherein the alternating voltage is turn on and off repeatedly in a plurality of times at the predetermined period, and the regulator regulates the maximum value of the ratio in accordance with the a plurality of the temperature detected by the temperature detector.

6. The image heating apparatus according to claim 4, wherein the ratio set by the controller is 50% when the alternating voltage is supplied to the heater at the predetermined period to regulate the maximum value of the ratio.

7. The image heating apparatus according to claim 1, wherein the predetermined period is longer than 0.25 seconds and shorter than 5.00 seconds.

8. An image heating apparatus comprising:

an endless belt configured to heat a toner image on a recording material at a nip portion;

a heater configured to heat the endless belt at the nip portion;

a roller configured to form the nip portion between the endless belt and the roller;

a voltage supplier configured to supply an alternating voltage to the heater;

a temperature detector configured to detect a temperature of the heater;

a controller configured to control a ratio of a time during which the voltage is supplied to the heater to a period at which the alternating voltage is supplied to the heater in accordance with the temperature detected by the temperature detector; and a setting unit configured to set the maximum value of the ratio in accordance with an amount of change in the detected temperature by turning on and off the alternating voltage supplied to the heater at a period that is longer than 0.25 seconds and shorter than 5.00 seconds.

9. The image heating apparatus according to claim 8, wherein the alternating voltage is turn on and off repeatedly in a plurality of times at the period that is longer than 0.25 seconds and shorter than 5.00 seconds, and the regulator regulates the maximum value of the ratio in accordance with the a plurality of the temperature detected by the temperature detector.

10. The image heating apparatus according to claim 8, wherein the ratio set by the controller is 50% when the alternating voltage is supplied to the heater at the period that is longer than 0.25 seconds and shorter than 5.00 seconds to regulate the maximum value of the ratio.

11. The image heating apparatus according to claim 8, wherein the roller is disposed at a position so as to sandwich the endless belt between the heater and the roller.

12. The image heating apparatus according to claim 8, wherein the endless belt fixes an unfixed toner image, as the toner image, onto the recording material at the nip portion by heat.

* * * * *